US005643001A

United States Patent [19]

Kaufman et al.

[11] Patent Number: 5,643,001

[45] Date of Patent: Jul. 1, 1997

[54] MEMORY CARD CONNECTOR

[75] Inventors: John Wilson Kaufman, Hershey; Edgar Charles Gorman, Harrisburg; Robert Wayne Elicker, Dillsburg, all of Pa.

[73] Assignee: The Whitaker Corporation, Wilmington, Del.

[21] Appl. No.: 686,788

[22] Filed: Jul. 26, 1996

[51] Int. Cl.[6] ..... H01R 13/635

[52] U.S. Cl. ..... 439/159; 439/541.5

[58] Field of Search ..... 439/541.5, 79, 439/64, 159

[56] References Cited

U.S. PATENT DOCUMENTS

| | | | |
|---|---|---|---|
| 4,918,572 | 4/1990 | Tarver et al. | 361/395 |
| 5,149,276 | 9/1992 | Dixon | 439/159 |
| 5,176,523 | 1/1993 | Lai | 439/64 |
| 5,290,174 | 3/1994 | Woratyla et al. | 439/59 |
| 5,299,089 | 3/1994 | Lwee | 361/684 |
| 5,318,452 | 6/1994 | Brennian, Jr. et al. | 439/79 |
| 5,324,204 | 6/1994 | Lwee | 439/64 |
| 5,399,105 | 3/1995 | Kaufman et al. | 439/609 |
| 5,401,176 | 3/1995 | Lwee | 439/64 |
| 5,490,791 | 2/1996 | Yamada et al. | 439/541.5 |

*Primary Examiner*—Gary F. Paumen

[57] ABSTRACT

A memory card connector (50) is disclosed having an upper card receiving cavity (164) and a lower card receiving cavity (170). Upper and lower pin headers (56, 60) are attached to upper and lower ejectors (110, 112) to form the two cavities (164, 170). Each cavity is defined by right and left side walls (118, 120, 158, 160) interconnected by a lateral member (122, 162) extending along a major side (168, 174) of the cavity. The upper cavity (164) has one major side (166), opposite the lateral member (122), that is open so that a Type III memory card (200), when inserted into the cavity in mated engagement with the connector, can project through the open major side (166).

14 Claims, 7 Drawing Sheets

MEMORY CARD CONNECTOR

The present invention relates to memory card connectors and more particularly to such connectors having two cavities, the first of which is arranged for receiving either a standard height memory card of Type I or Type II, or a raised profile memory card of Type III, and concurrently, the second of which is arranged to receive a Type I or Type II memory card.

BACKGROUND OF THE INVENTION

Memory cards are commonly used in various kinds of electronic equipment in the communications and computer industries in areas such as telecommunication, network routing, personal computers, laptop computers, and a host of specialized equipment. These memory cards are presently arranged within three types, Type I, Type II, and Type III, as defined by Personal Computer Memory Card International Association (PCMCIA) and Japan Electronics Industry Development Association (JEIDA), the industry standards. The Type I cards have the lowest profile, or height and typically contain random access memory (RAM), but may contain proprietary programs and other data in read only memory (ROM) format as well. The Type II cards have a slightly higher profile than the Type I card and typically contain electronic device assemblies such as FAX/MODEM units for communications, and may contain RAM or ROM as well. The Type III cards are high profile, being about twice as high as the Type II cards and typically contain hard disc drive units, but may contain other electronic devices that require the increased volume offered by the high profile Type III cards.

In the equipment that utilize these memory cards, space within the equipment is minimized to provide a smaller and lighter end product. This, of course, means that the connectors that interconnect the memory cards to the electronic equipment must also be as small and light as possible. These connectors are usually packaged to receive two memory cards concurrently, one stacked above the other. Such a memory card connector is show in FIG. 1 and identified as 10. The connector 10 includes an upper pin header 12 and a lower pin header 14 in stacked arrangement and secured together by means of stacking clips 16 that are forced into slots in the two pin headers. Each of the two pin headers includes electrical pin contacts therein having leads 18 that extend outwardly and downwardly to interconnect with contacts on a circuit board to which the connector 10 is to be mounted. The electrical pin contacts interconnect to mating contacts in the memory cards when the memory cards, not shown, are inserted into the connector 10. The connector 10 includes upper and lower right side walls 20 and 22, respectively, that extend outwardly from the right ends of the upper and lower pin headers 12 and 14, respectively, as shown in FIG. 1. Similarly, upper and lower left side walls 24 and 26 extend outwardly from the left end of the upper and lower pin headers 12 and 14, respectively, as shown in FIG. 1. A lower lateral member 28 extends between and is attached to the two lower side walls 22 and 26, and an upper lateral member 30 extends between and is attached to the two upper side walls 20 and 24. A track is formed in the inside surface of each of the side walls 20, 22, 24, and 26 thereby forming an upper card receiving cavity 34 and a lower card receiving cavity 36, one above the other. Each of these two cavities is sized to receive either a Type I or Type II memory card concurrently with the other cavity. Additionally, the lower cavity 36 can receive a Type III high profile memory card, however, a portion of the Type III card must necessarily intrude into the upper cavity 34 thereby preventing use of that cavity by another memory card. Lwee U.S. Pat. No. 5,299,089 which issued Mar. 29, 1994 discloses a memory card connector capable of concurrently receiving both a Type I or II card in one cavity and a Type III card in another cavity. However, the overall height of the connector is increased to accommodate the additional height of the Type III card. This overall height increase in the connector adversely affects the available usable space when the equipment that contains the connector does not require a Type III memory card. Additionally, as the industry moves toward faster data transfer rates, these memory card connectors will require suitable shielding to prevent crosstalk between the two memory cards. It is difficult for the present prior art memory card connectors to accommodate such shielding.

What is needed is a memory card connector that can either accommodate two Type I or Type II cards in two separate cavities or can accommodate one Type I or Type II card in one of the cavities and concurrently a Type III card in the other cavity while increasing the overall height of the connector and memory card assembly a minimum amount. Further, the memory card connector should include shielding that inhibits crosstalk between the two memory cards that are contained in the two cavities.

SUMMARY OF THE INVENTION

A memory card connector that is arranged to be secured to a mounting surface is disclosed. The connector includes an insulated housing having a plurality of electrical contacts therein. Two spaced apart side walls extend from opposite ends of the housing thereby defining first and second adjacent memory card receiving cavities between the side walls. Each of the first and second memory card receiving cavities has first and second major sides extending from the first side wall to the second side wall. Each of the cavities is arranged to receive a memory card therewithin. A first lateral member extends along a portion of the second major side of the first cavity interconnecting the two side walls. Similarly, a second lateral member extends along a portion of the second major side of the second cavity interconnecting the two side walls. The second major side of the first cavity is in opposed relationship with the first major side of the second cavity and the first major side of the first cavity is open.

DESCRIPTION OF THE PREFERRED EMBODIMENT

Figure 2:
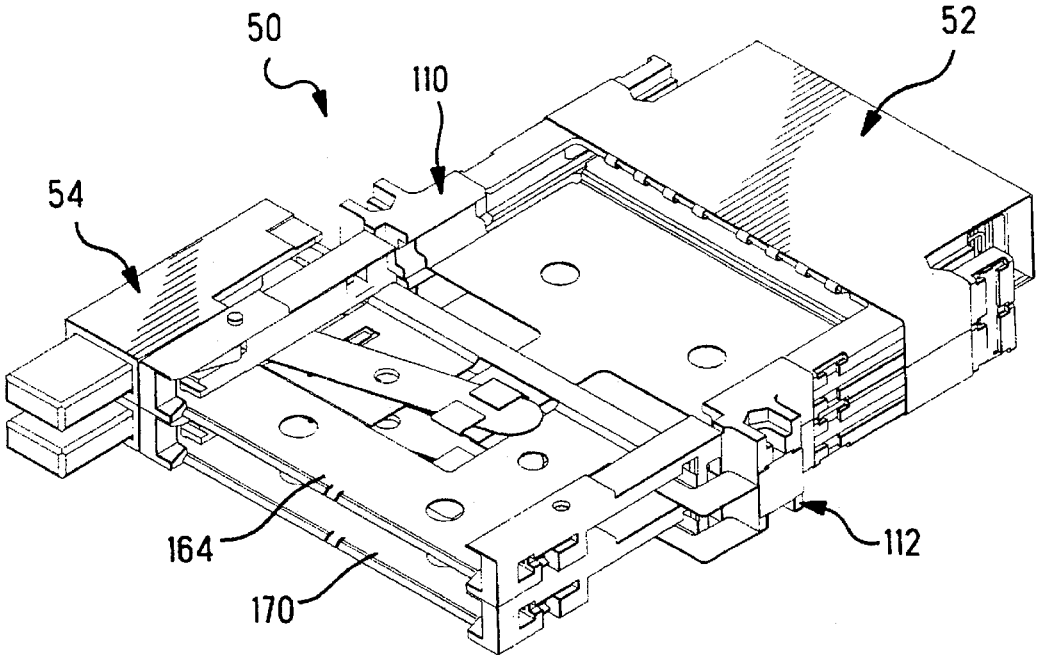
FIG. 2 is an isometric view of a memory card connector incorporating the teachings of the present invention.
Figure 3:
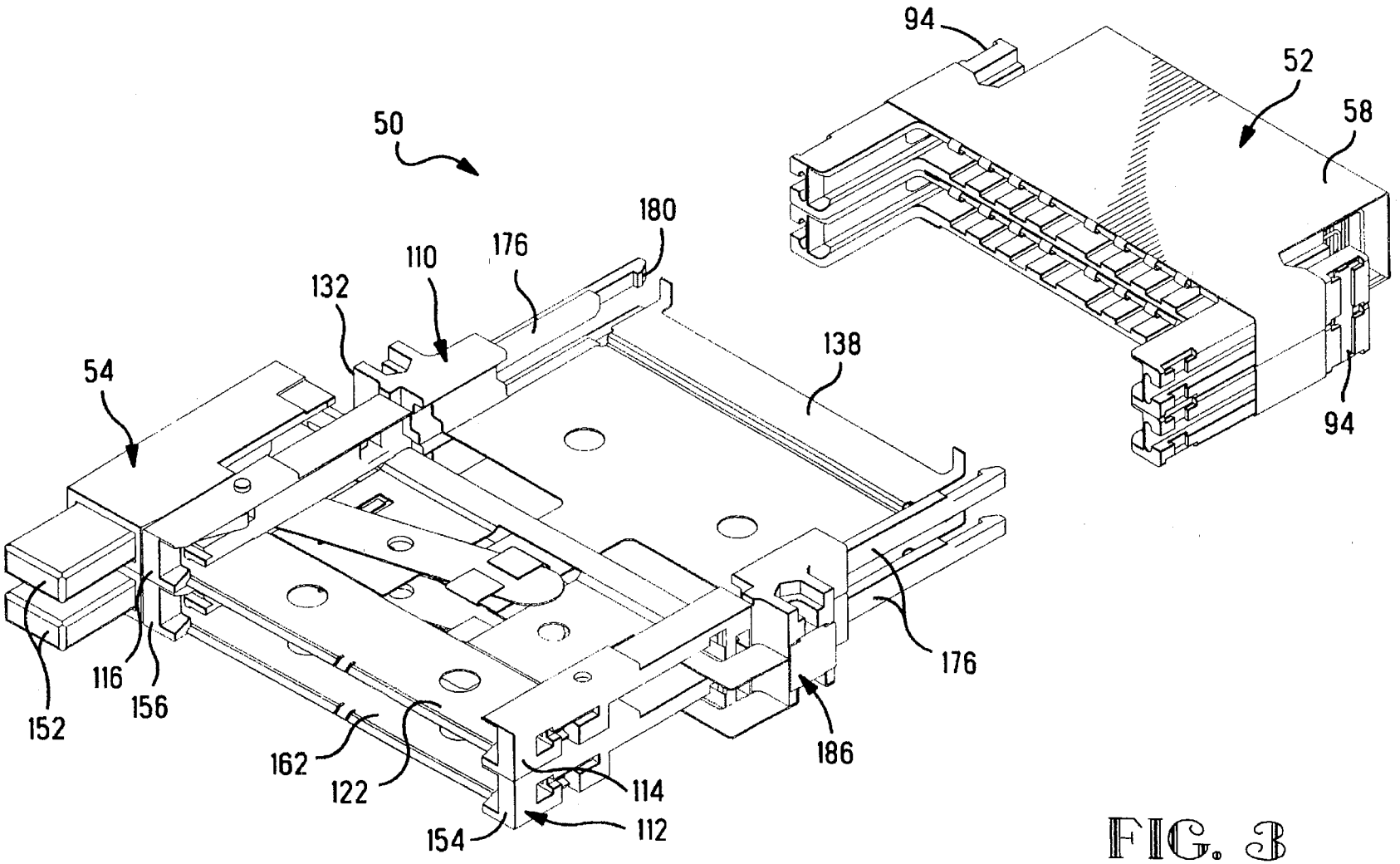
FIG. 3 is an isometric view of the connector shown in FIG. 2 shown partially disassembled.
Figure 4:
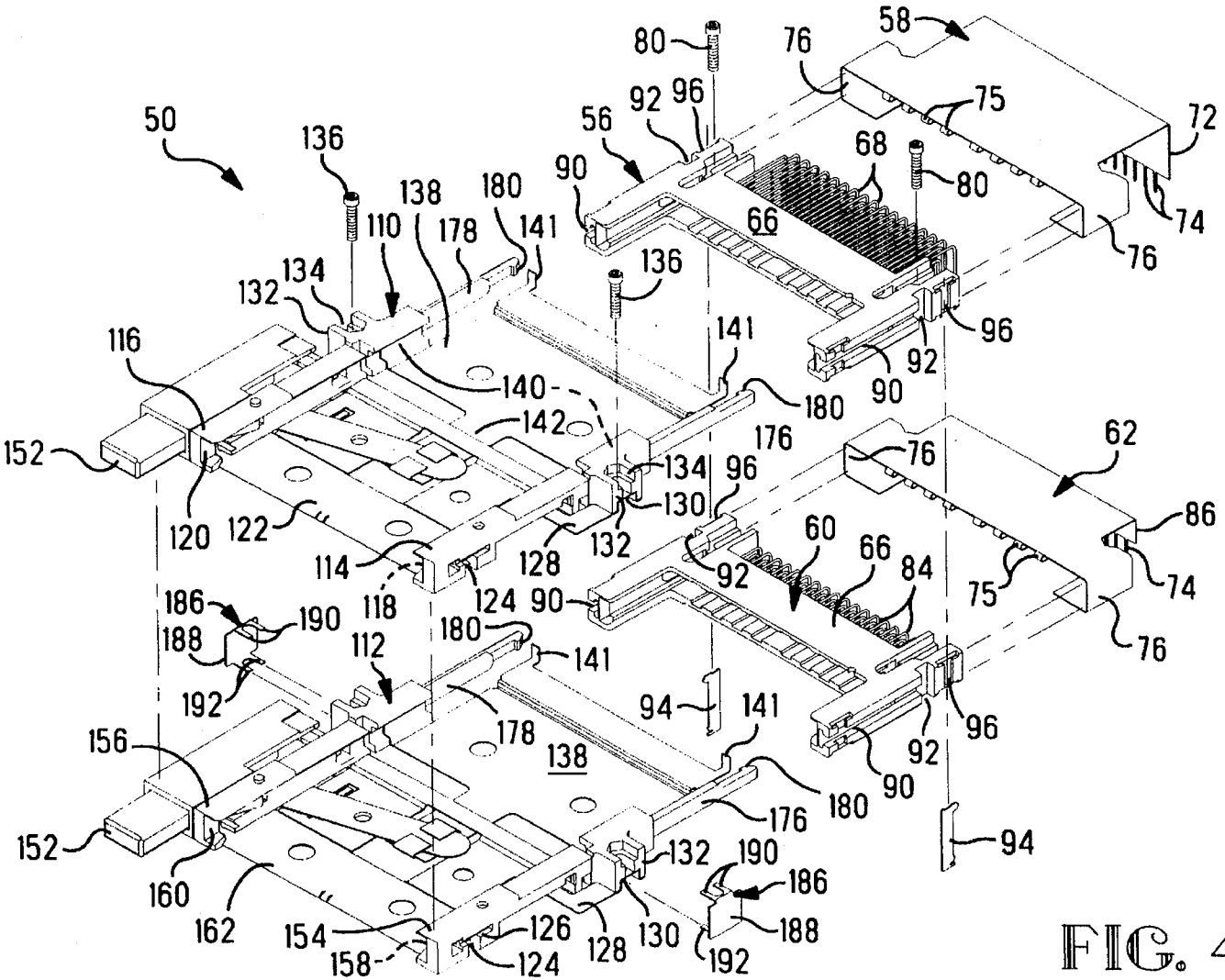
FIG. 4 is an exploded parts view of the connector shown in FIG. 2.
Figure 8:
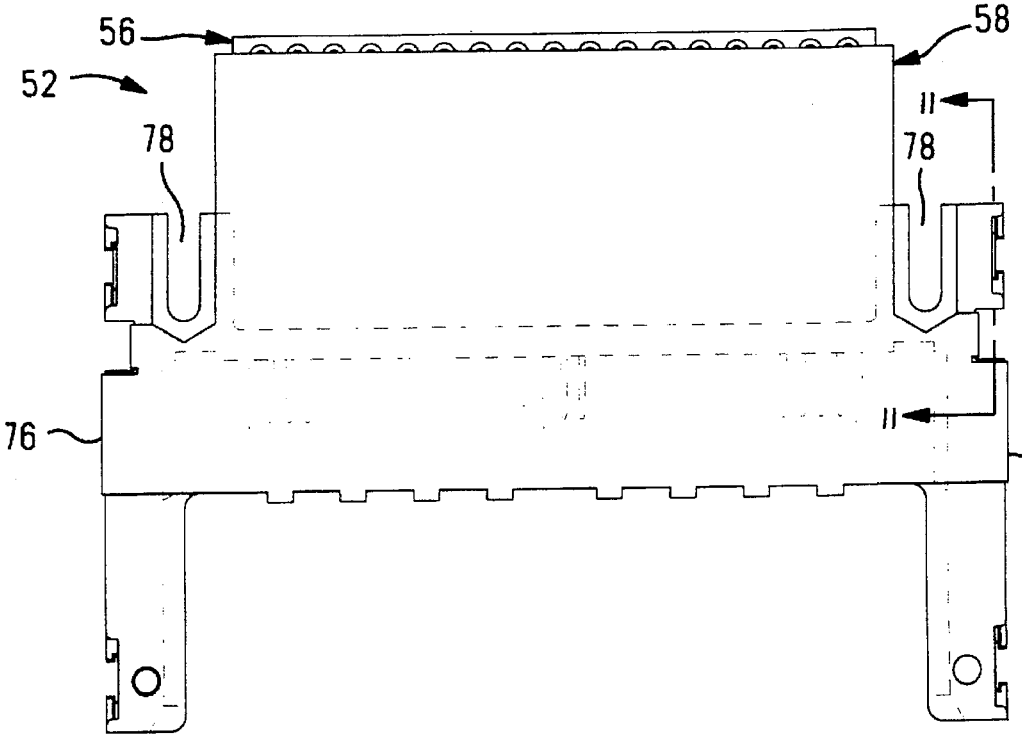
FIGS. 8 and 9 are plan and front views of the pin headers of the connector shown in FIG. 2.
Figure 9:
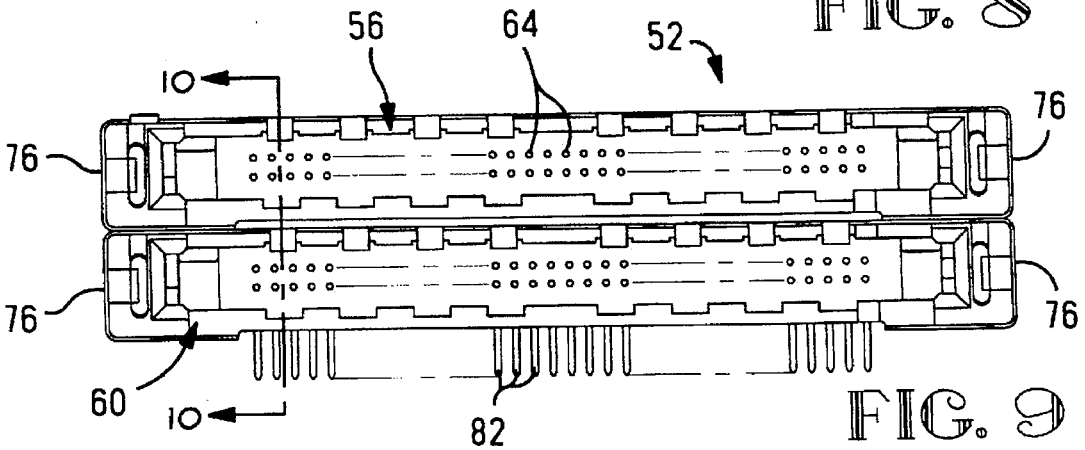
Figure 10:
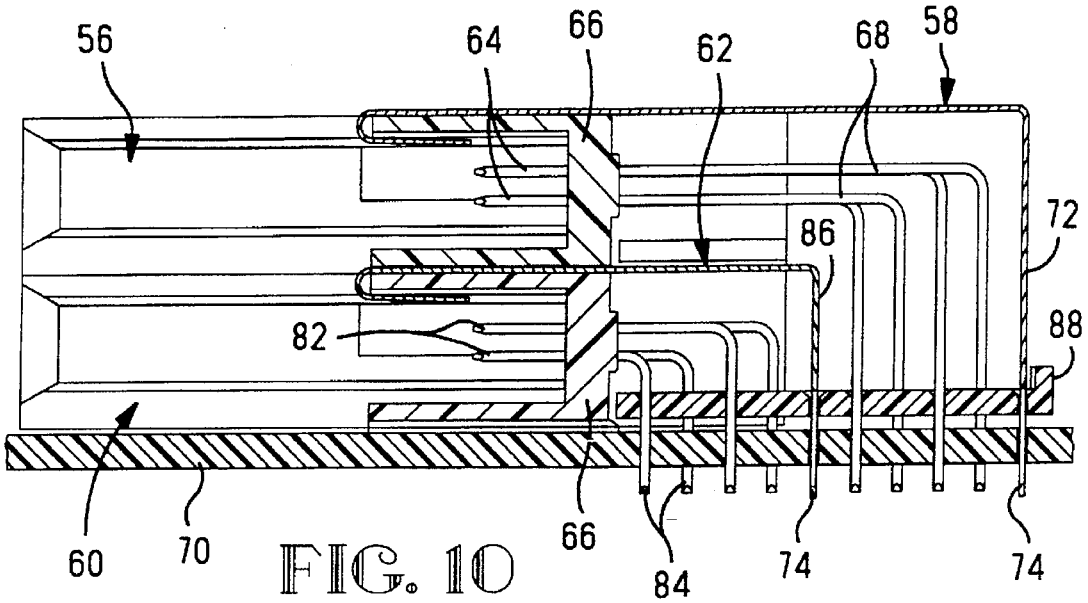
FIG. 10 is a cross-sectional view taken along the lines 10—10 in FIG. 9.
Figure 11:
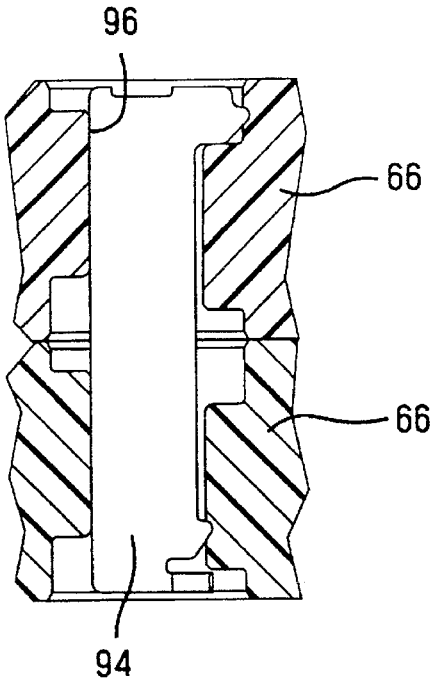
FIG. 11 is a cross-sectional view taken along the lines 11—11 in FIG. 8.

There is shown in FIGS. 2, 3, and 4 a memory card connector 50 having a pin header assembly 52 and an ejector assembly 54 having two card receiving cavities, 164, 170. As best seen in FIG. 4, the pin header assembly 52 includes an upper pin header 56 and upper shield 58 and a lower pin header 60 and lower shield 62. The upper pin header 56, as shown in FIGS. 9 and 10, has a plurality of electrical pin contacts 64 extending through an insulating housing 66. Each pin contact terminates in a lead 68 that extends outwardly and downwardly toward and into engagement with circuits on a circuit board 70. The upper shield 58 is made of a relatively thin electrically conductive material such as sheet brass or phosphorous bronze and completely covers the upper portions of the leads 68 and the portion of the housing 66 containing the pin contacts 64. The upper shield 58 includes a flange 72 that is bent approximately 90 degrees to the main portion of the shield and has ground leads 74 extending through the circuit board 70 for engagement with a ground circuit on the board, if desired. Ground fingers 75 extend from a front edge of the main portion of the upper shield 58, bend underneath and extend toward the flange 72 for electrical engagement with a ground strip on the memory card when the memory card is inserted into the ejector 110. Additionally, the upper shield 58 includes a U-shaped bracket 76, as best seen in FIG. 4, that wraps around opposite outer edges of the housing 66 to secure the shield in place. A pair of slots 78 are formed in opposite sides of the housing 66, as shown in FIG. 8, for receiving screws 80, as shown in FIG. 4, for mounting the pin header assembly 52 to the circuit board 70. The lower pin header 60 has a housing that is identical to the housing 66 of the upper pin header 56 and, therefore, is identified with the number 66 as well. The lower pin header 60 includes a plurality of electrical pin contacts 82 extending through the lower housing 66 and terminating in leads 84 that extend outwardly and downwardly toward and into engagement with circuits on the circuit board 70. The lower shield 62 is similar to the upper shield 58 except that it extends outwardly only sufficiently far to cover the portion of the housing containing the pin contacts 82 and the leads 84 and then a flange 86 is bent downwardly through about 90 degree to pass between the sets of leads 84 and 68. Ground fingers 75 extend from a front edge of the main portion of the lower shield 62 in a manner similar to that of the upper shield 58, for electrical engagement with a ground strip on the memory card when the memory card is inserted into the ejector 112. The flange 86 has ground leads 74 extending through the circuit board 70 for engagement with a ground circuit on the board, if desired. As with the upper shield 58, the lower shield 62 includes a U-shaped bracket 76, as best seen in FIG. 4, that wraps around opposite outer edges of the housing 66 to secure the shield in place. A plastic lead organizer 88 having openings arranged on identical center to center spacing as the circuit contact holes in the circuit board 70, is arranged with the leads 58, 74, and 84 extending through their respective openings, in the usual manner as shown in FIG. 10. Each housing 66 includes a groove 90 in two opposite walls running parallel to the pin contacts within the housing. Each of the grooves 90 terminates in a notch 92 formed in the wall of the housing slightly deeper than the groove. The purpose of the grooves 90 and notches 92 will be explained below. The upper and lower housings 66 are secured together by means of two stacking clips 94 that are in an interference fit with openings 96 in the outer walls of the housings, as best seen in FIGS. 4 and 11.

Figure 5:
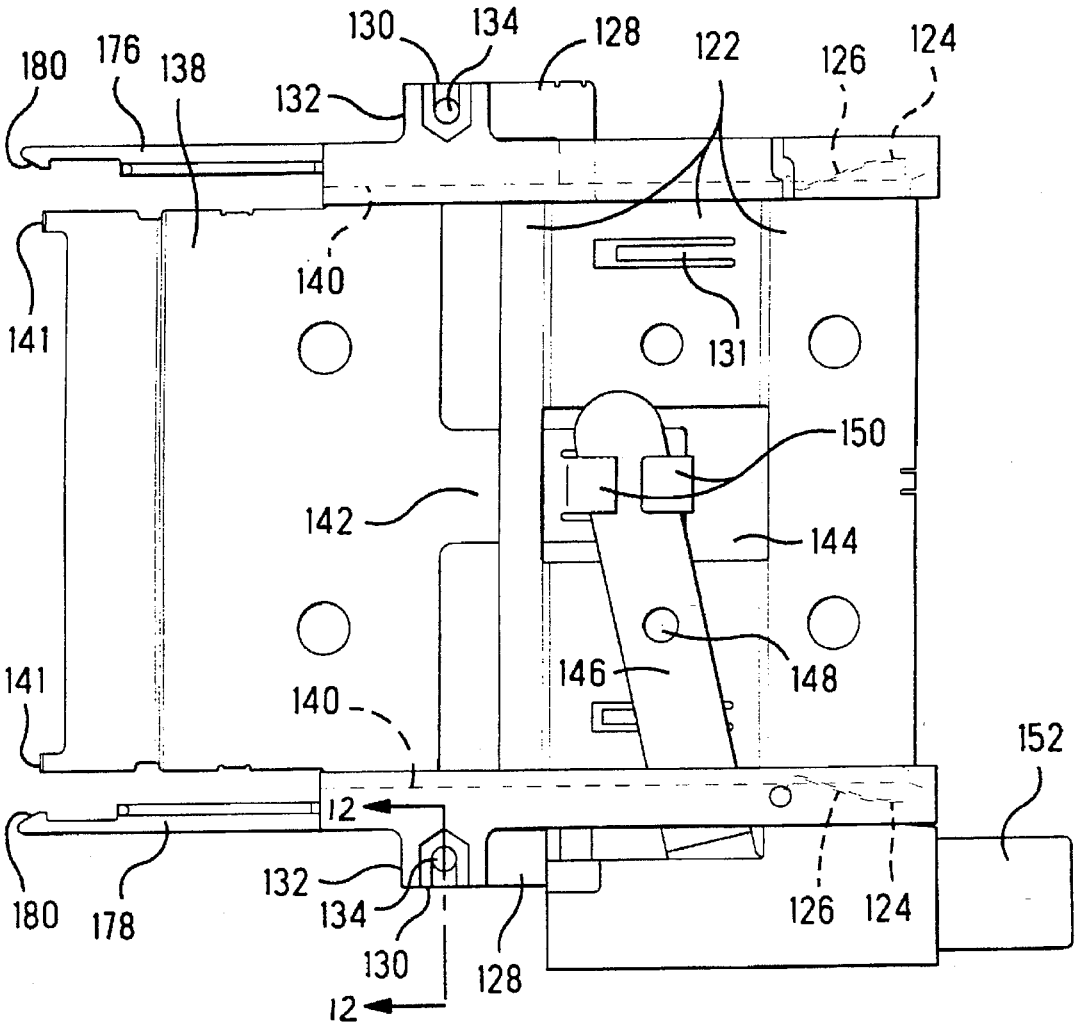
FIGS. 5, 6, and 7 are plan, side, and front views, respectively, of a portion of the connector shown in FIG. 2.

The ejector assembly 54, as shown in FIGS. 3 and 4 through 7, includes an upper ejector 110 and a lower ejector 112, the two ejectors being substantially identical. The upper ejector 110 includes right and left arms 114 and 116 having right and left side walls 118 and 120, respectively, that are interconnected by an upper lateral member 122. The right and left side walls 118 and 120 form tracks for receiving and guiding the edges of a memory card in the usual manner. The upper lateral member 122 is made of relatively thin sheet metal and includes tabs 124 that extend into and are in an interference fit with openings 126 in the arms 114 and 116. Additionally, the upper lateral member 122 includes a pair of grounding strips 128 that extend from opposite sides of the lateral member, as best seen in FIGS. 4 and 5, and terminate in reversed U-shaped portions 130. A ground contact 131 is formed in the upper lateral member 122 and extends upwardly for electrical engagement with the outer casing of a memory card when the card is inserted into the connector 50. Each of the portions 130 extend into the underside of a respective boss 132 that is attached to each of the arms 114 and 116. An opening 134 is provided in each boss 132 for receiving mounting screws 136 which secure the memory card connector to the circuit board 70, as will be explained below. A memory card ejection member 138 having two spaced apart bent up tabs 141 for engaging the end of a memory card during insertion and ejection is slidingly coupled to the right and left arms 114 and 116. This is effected by means of a slide portion 140 formed along opposite edges of the member 138 in sliding engagement with a channel formed in the right and left side walls 118 and 120, respectively. The ejector member 138 includes a shank 142 that extend under a portion of the upper lateral member 122 and into an opening 144 in the lateral member, as best seen in FIG. 5. An actuator arm 146, which is pivotally attached to the upper lateral member 122 at the point 148, has one end extending through a nest formed by two bent over tabs 150 in the shank 144, and the other end is coupled to an actuating button 152. The operation of this ejection mechanism will be described below.

The lower ejector 112 includes right and left arms 154 and 156 having right and left side walls 158 and 160, respectively, that are interconnected by a lower lateral member 162. The right and left side walls 118 and 120 form tracks for receiving and guiding the edges of a memory card in the usual manner. While the arms 154 and 156, side walls 158 and 160, and lateral member 162 are identical to the arms 114 and 116, side walls 118 and 120, and lateral member 122, they have been given their own identifying numbers to more clearly differentiate between their respective functions, as will be explained. In all other respects, the elements of the lower ejector 112 are similar to corresponding elements of the upper ejector 110 and are identified with similar identifying numbers and, therefore, will not be described again.

Figure 6:
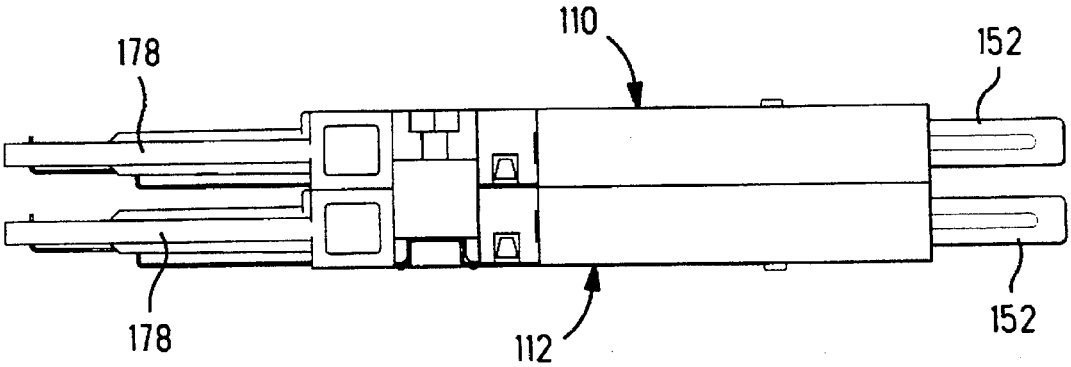
Figure 7:
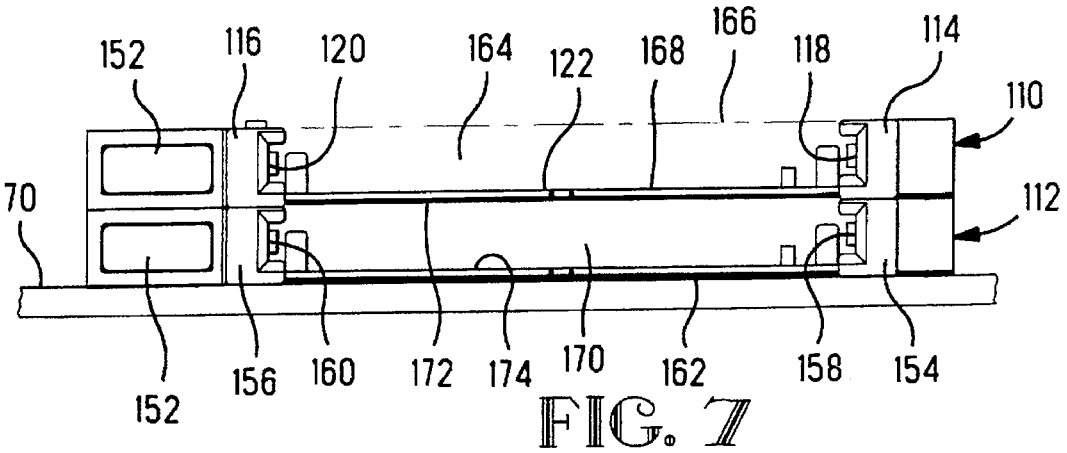

As best seen in FIG. 7, the side walls 118 and 120 and the upper lateral member 122 define an upper card receiving cavity 164 having a first major side 166 that is open, indicated by phantom lines, and a second major side 168 that is bounded by the upper lateral member 122 and upper ejector member 138. The side walls 158 and 160 and the lower lateral member 162 define a lower card receiving cavity 170 having a first major side 172 that is bounded by the upper lateral member 122, and a second major side 174 that is bounded by the lower lateral member 162 and lower ejector member 138. As shown in FIGS. 5 and 6, each of the right and left arms 114 and 116 and each of the right and left arms 154 and 156 include right and left extended portions 176 and 178, respectively. Each extended portion 176 and 178 terminates in an inwardly projecting catch 180, as best seen in FIG. 5. The extended portions 176 and 180 are sized to freely slide in the grooves 90 of the upper and lower pin headers 56 and 60, respectively to the position shown in FIG. 2. The catch 180 of each extended portion latchingly engages a wall of a respective notch 92 to secure the upper and lower ejectors 110 and 112 to their respective upper and lower pin headers 56 and 60. This results in the pin header and the ejector being joined together to form a unit with the right and left side walls 118 and 120 of the upper ejector 110 extending from the upper pin header 56 and the right and left side walls 158 and 160 of the lower ejector 112 extending from the lower pin header 60.

Figure 1:
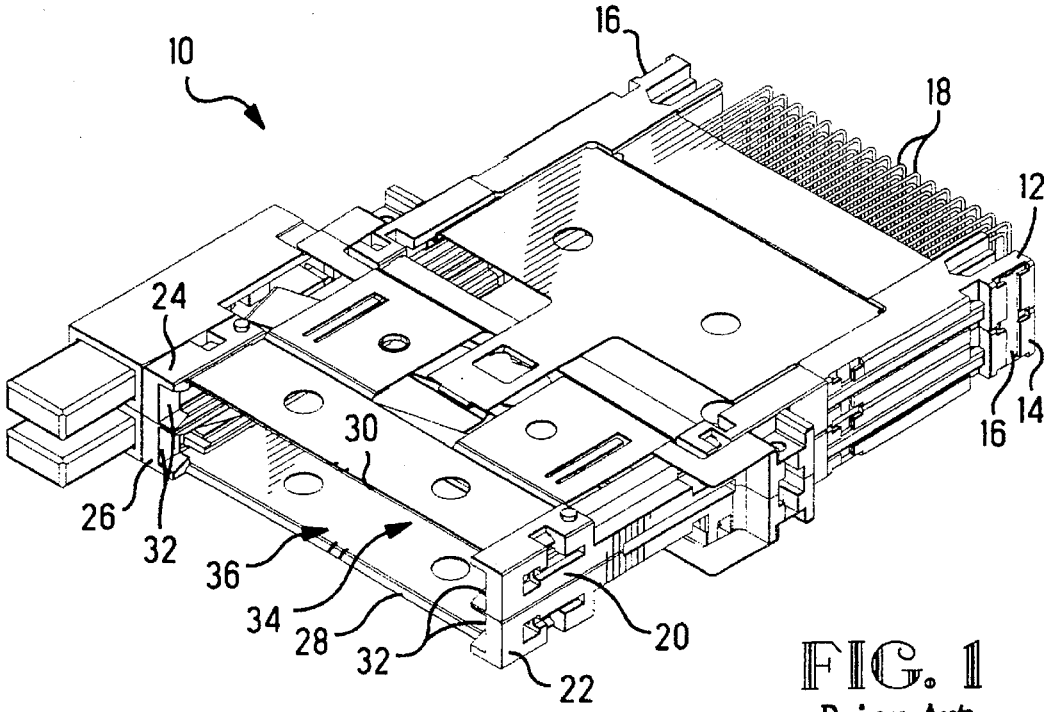
FIG. 1 Prior Art
FIG. 1 is an isometric view of a prior art memory card connector.
Figure 12:
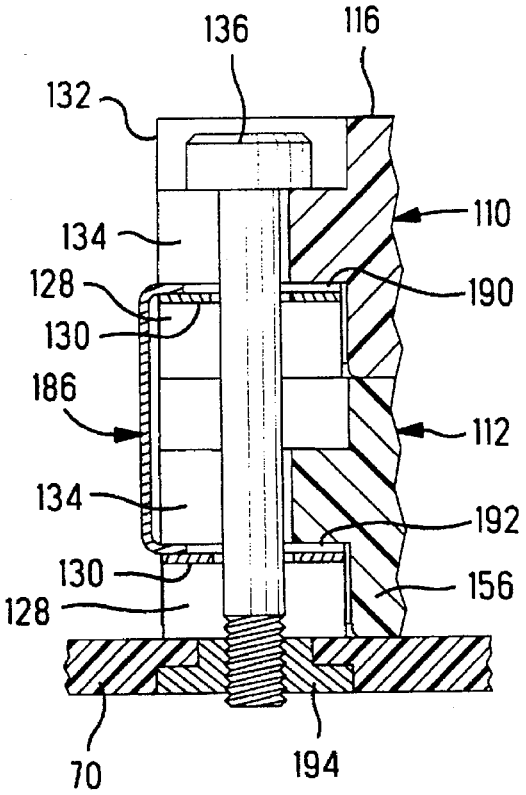
FIG. 12 is a cross-sectional view taken along the lines 12—12 in FIG. 5.

As shown in FIGS. 4 and 12, a U-shaped ground clip 186 having a main body 188 and upper and lower outwardly projecting tabs 190 and 192, respectively, electrically interconnects the two ground strips 128 on the right side of the upper and lower lateral members 122 and 162. Similarly, another U-shaped ground clip 186 interconnects the two ground strips 128 on the left side. Each U-shaped clip 186 engages the upper and lower U-shaped portions 130 of a respective ground strip 128, as best seen in FIG. 12. The tabs 190 are sandwiched between the arm 116 of the upper ejector 110 and its U-shaped portion 130 and the tabs 192 are sandwiched between the arm 156 of the lower ejector 112 and its U-shaped portion 130 so that good electrical continuity is achieved between the upper and lower U-shaped portions 130 and the upper and lower lateral members 122 and 162, respectively. The two mounting screws 136 extend through the openings 134 in the bosses 132, through clearance holes in the U-shaped portions 130, and into threaded engagement with nuts 194 embedded in the circuit board 70, as shown in FIG. 12. This structure effectively provides an excellent ground path for both the upper and lower lateral members 122 and 162 without the need for relying upon good electrical contact between the head of the screw 136 and one of the U-shaped portions 130, as is required in the prior art connector shown in FIG. 1, Importantly, this ground path is used to discharge any static charge that is present on the memory card as it is being inserted into the connector 50.

Figure 13:
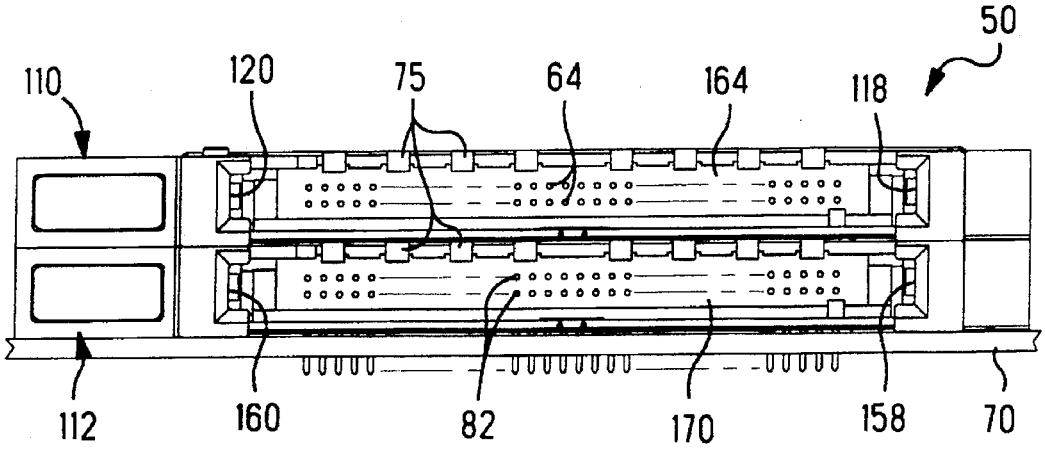
FIG. 13 is a front view of the connector shown in FIG. 2.
Figure 14:
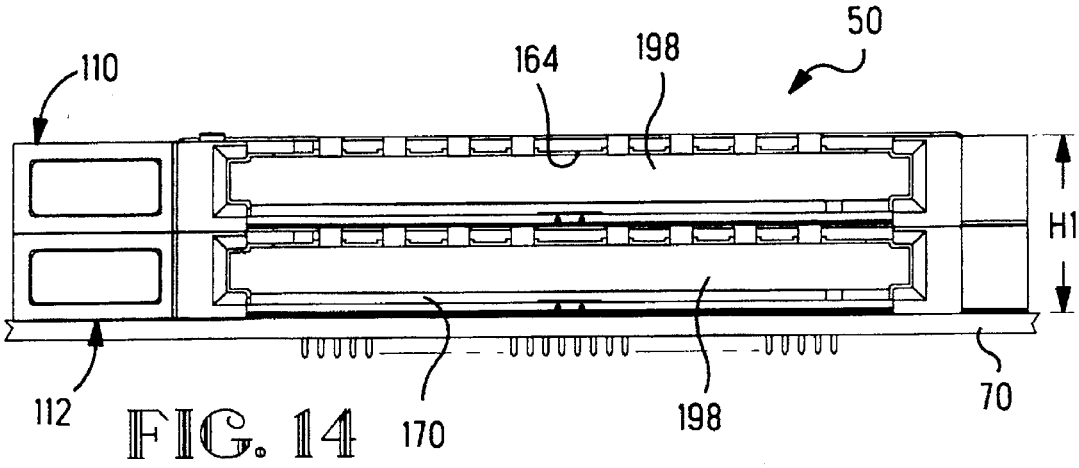
FIGS. 14 and 15 are views similar to that of FIG. 13 showing two different operating configurations of the connector.
Figure 15:
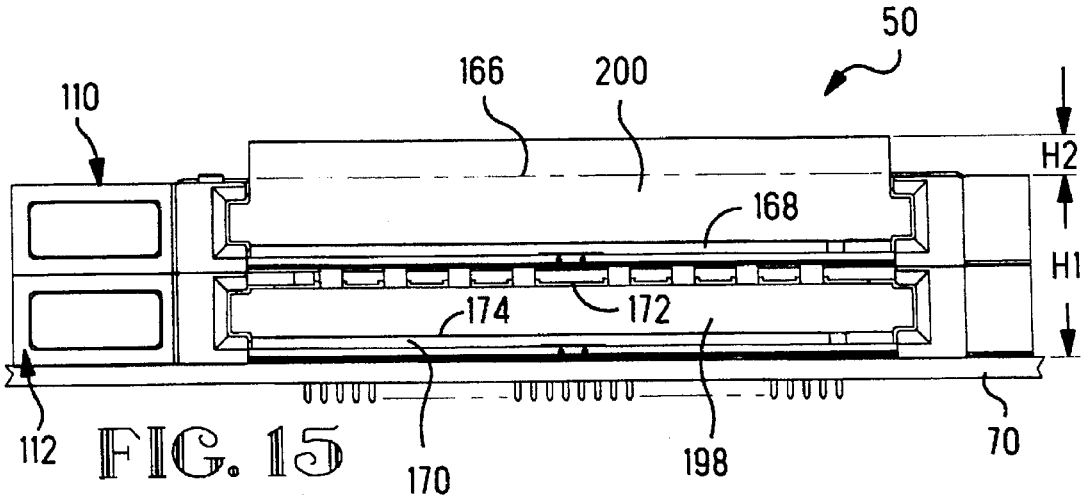

The operation of the memory card connector 50 will now be described with reference to FIGS. 5 and 13 through 15. The memory card connector 50 is shown in FIG. 13 with both the upper and lower card receiving cavities 164 and 170 empty. When a Type I or Type II memory card is inserted into either the upper ejector 110 or the lower ejector 112 the card engages the two tabs 141 causing the ejector member 138 to slide away from the lateral member to the position shown in FIG. 5 where button 152 is extending outwardly and the card engages the pin contacts 64 or 82. When the button 152 is depressed, the arm 146 is caused to pivot about the point 148 thereby causing the shank 142 and eject member 138 to slide toward the lateral member 122 or 162 thereby ejecting the memory card. The memory card connector 50 is shown in FIG. 14 with a Type II memory card 198 fully inserted in both the upper and lower card receiving cavities 164 and 170. Note that, in this case, the two memory cards are within the overall height of the connector 50, indicated as H1 in FIG. 14. With this usage of the memory card connector 50 the host equipment containing the memory card connector need only provide for the height H1. On the other hand, where the host equipment requires both a Type II and a Type III card, the connector 50 is configured as shown in FIG. 15 with a Type I or Type II memory card 198 fully inserted in the lower card receiving cavity 170 and a Type III memory card concurrently fully inserted in the upper card receiving cavity 164. In this case a portion of the high profile Type III memory card extends above the connector 50 an amount indicated as H2 in FIG. 15. With this usage of the memory card connector 50 the host equipment containing the memory card connector must provide for the height H1 and the additional height H2. However, this structure results in a substantial reduction in height requirements for the memory card connector 50 when a Type III card is not required, while having the capability of accommodating a Type III card when required.

While the present memory card connector 50 includes stacked upper and lower pin headers and stacked upper and lower ejectors, a single housing containing the elements of the two pin headers and the two ejectors could advantageously be utilized in the practice of the present invention. Further, while the memory card connector 50 has been described as having upper and lower pin headers, upper and lower ejectors, and upper and lower card receiving cavities, it will be understood that this terminology is used for convenience only and is not intended to limit the present invention to a particular orientation related to up and down. The memory card connector 50 may be used in any orientation such as vertically where the pairs of components are side by side instead of one above the other. Additionally, it will be understood that the specific structure of the memory card connector 50, as described herein, is by way of example only and that the teachings of the present invention may be advantageously practiced in memory card connectors having other structures such as, for example, a connector having a different ejector mechanism or having the buttons 152 located in a different position.

An important advantage of the present invention is that a substantial reduction in connector height is realized when a Type III memory card is not required but the memory card connector is able to accommodate a Type III card when required to do so. Another important advantage is that the upper and lower shields permit faster data transfer rates than prior art memory card connectors and the U-shaped ground clip provides a more efficient and secure ground connection between the two lateral members for the discharge of static electricity than would be possible with prior art memory card connectors.

We claim:

1. A memory card connector arranged to be secured to a mounting surface comprising:

(a) an insulated housing having a plurality of electrical contacts therein;

(b) two spaced apart side walls extending from opposite ends of said housing defining first and second adjacent memory card receiving cavities therebetween, each of said first and second memory card receiving cavities having first and second major sides extending from said first side wall to said second side wall, each said cavity arranged to receive a memory card therewithin;

(c) a first lateral member extending between said first and second cavities along a portion of said second major side of said first cavity interconnecting said two side walls and a second lateral member extending along a portion of said second major side of said second cavity interconnecting said two side walls;

wherein said first major side of said first cavity is open;

wherein when the memory card connector is secured to said mounting surface, said second lateral member is adjacent said mounting surface and said open first major side of said first cavity is away from said mounting surface;

the memory card connector being adapted to receive a memory card of standard height within said second cavity and concurrently receive a raised profile memory card within said first cavity, wherein a portion of said raised profile memory card extends through said open first major side of said first cavity.

2. The memory card connector according to claim 1 wherein said first lateral member extends along portions of both said second major side of said first cavity and said first major side of said second cavity.

3. The memory card connector according to claim 1 wherein said two side walls are arranged to guide each said memory card into aligned engagement with respective contacts of said plurality of electrical contacts.

4. The memory card connector according to claim 3 wherein each of said two side walls includes a track adjacent each of said first and second cavities for receiving an edge of a respective said memory card.

5. The memory card connector according to claim 1 including a first card ejection member in sliding engagement with said two side walls and extending along a different portion of said second major side of said first cavity and a second card ejection member in sliding engagement with said two side walls and extending along a different portion of said second major side of said second cavity.

6. The memory card connector according to claim 1 wherein some of said plurality of electrical contacts are adjacent said first cavity and others of said plurality of electrical contacts are adjacent said second cavity, said connector including a shielding layer of conductive material disposed between said some of said plurality of electrical contacts and said others of said plurality of electrical contacts.

7. The memory card connector according to claim 6 including another shielding layer of conductive material arranged so that said some of said plurality of electrical contacts are between said shielding layer and said another shielding layer.

8. A memory card connector arranged to be secured to a mounting surface comprising:

(a) an upper pin header having electrical contacts and a lower pin header having electrical contacts, in stacked relationship;

(b) an upper card holder and ejector assembly having two spaced apart side walls extending into engagement with opposite ends of said upper pin header defining a first memory card receiving cavity therebetween, and a lower card holder and ejector assembly having two spaced apart side walls extending into engagement with opposite ends of said lower pin header defining a second memory card receiving cavity therebetween, said upper and lower card holder and ejector assemblies being in stacked relationship, each of said first and second memory card receiving cavities having first and second major sides extending from said first side wall to said second side wall;

(c) a first lateral member extending between said first and second cavities along a portion of said second major side of said first cavity interconnecting said two side walls of said upper card holder and ejector assembly and a second lateral member extending along a portion of said second major side of said second cavity interconnecting said two side walls of said lower card holder and ejector assembly;

wherein said first major side of said first cavity is open;

wherein when the memory card connector is secured to said mounting surface, said second lateral member is adjacent said mounting surface and said open first major side of said first cavity is away from said mounting surface;

the memory card connector being adapted to receive a memory card of standard height within said second cavity and concurrently receive a raised profile memory card within said first cavity, wherein a portion of said raised profile memory card extends through said open first major side of said first cavity.

9. The memory card connector according to claim 8 wherein each of said two side walls of each of said upper and lower card holder and ejector assemblies includes a catch formed on an end thereof that interlocks with an opening on a respective end of said upper and lower pin headers.

10. The memory card connector according to claim 8 wherein said first and second lateral members are electrically conductive, said connector including a U-shaped clip in electrically interconnecting engagement with both said first and second lateral members.

11. The memory card connector according to claim 10 including a first shielding layer of conductive material disposed between said electrical contacts of said upper pin header and said electrical contacts of said lower pin header.

12. The memory card connector according to claim 11 including a second shielding layer of conductive material arranged so that said electrical contacts of said upper pin header are between said first and second shielding layers.

13. The memory card connector according to claim 8 wherein each of said two side walls of both said upper and lower card holder and ejector assemblies includes a track arranged to guide each said memory card into aligned engagement with said electrical contacts of said upper and lower pin headers, respectively.

14. The memory card connector according to claim 8 including a first card ejection member in sliding engagement with said two side walls of said first card holder and ejector assembly and extending along a different portion of said second major side of said first cavity and a second card ejection member in sliding engagement with said two side walls of said second card holder and ejector assembly and extending along a different portion of said second major side of said second cavity.

* * * * *